US009743697B1

(12) United States Patent
Gerecht et al.

(10) Patent No.: US 9,743,697 B1
(45) Date of Patent: Aug. 29, 2017

(54) TOOL FOR POSITIONING AND ALIGNING UNIFORM ACCOUTERMENT

(71) Applicants: Mark Gerecht, Madison, AL (US); Danny Montez, San Jose, CA (US)

(72) Inventors: Mark Gerecht, Madison, AL (US); Danny Montez, San Jose, CA (US)

(73) Assignee: Mentor Enterprises, Inc., Madison, AL (US)

( * ) Notice: Subject to any disclaimer, the term of this patent is extended or adjusted under 35 U.S.C. 154(b) by 148 days.

(21) Appl. No.: 14/740,038

(22) Filed: Jun. 15, 2015

(51) Int. Cl.
*A41H 3/01* (2006.01)
*G01D 21/00* (2006.01)
*A41D 29/00* (2006.01)

(52) U.S. Cl.
CPC ..... *A41D 29/00* (2013.01)

(58) Field of Classification Search
CPC ..... A41D 29/00
USPC ..... 33/653
See application file for complete search history.

(56) References Cited

U.S. PATENT DOCUMENTS 2,387,986 A * 10/1945 Evans ..... A41H 1/02 33/653
3,129,515 A * 4/1964 Best ..... A41D 29/00 33/653
3,331,342 A * 7/1967 Herrmann ..... D05B 3/10 112/136
3,376,651 A * 4/1968 Carey ..... A44C 3/001 33/653
4,302,884 A * 12/1981 Pallone ..... A44C 3/002 33/562
5,063,684 A * 11/1991 Winters ..... A41D 29/00 33/645
6,311,408 B1 * 11/2001 Madayag ..... A41D 27/20 33/1 G
7,559,153 B2 * 7/2009 Allen ..... B25H 7/00 33/563
7,587,839 B1 * 9/2009 Winter ..... A44C 3/002 33/653
7,637,028 B2 * 12/2009 Allen ..... A44C 3/002 33/563
8,112,898 B2 * 2/2012 Allen ..... A44C 3/002 33/563
D657,268 S * 4/2012 Rott ..... D10/64
8,359,763 B2 * 1/2013 Allen ..... A44C 3/002 33/563
8,640,366 B1 * 2/2014 Solberg ..... A45F 5/02 33/653
2007/0294924 A1 * 12/2007 Schriver ..... A44C 3/002 40/1.5

(Continued)

*Primary Examiner* — Yaritza Guadalupe-McCall
(74) *Attorney, Agent, or Firm* — Maynard Cooper & Gale, P.C.; Jon E. Holland

(57) ABSTRACT

A tool to position accouterments on a uniform includes a component having at least one opening extending through the component. The opening can receive an accouterment to be placed on a uniform. The tool has one or more reference lines indicated on at least one side. The opening is positioned in the component relative to the reference line to position on the uniform the accouterment placed in the opening when the reference line is aligned with the corresponding feature on the uniform. One side of the tool can be used to place accouterments on one side of the uniform while the another side of the tool can be used to place accouterments on another side of the uniform.

20 Claims, 9 Drawing Sheets

(56) References Cited

U.S. PATENT DOCUMENTS

| | | | | |
|---|---|---|---|---|
| 2013/0061484 | A1* | 3/2013 | Davignon | A41D 29/00 33/653 |
| 2015/0335188 | A1* | 11/2015 | Davis | A47G 25/28 223/85 |

* cited by examiner

TOOL FOR POSITIONING AND ALIGNING UNIFORM ACCOUTERMENT

BACKGROUND

The present application generally relates to a tool for positioning and aligning accouterments, such as insignia, ribbons, and badges, to be affixed on a uniform.

The placement of accouterment on the uniforms of military personnel is defined by regulations. The regulations define where accouterments are to be placed on the uniform and the position and orientation of each accouterment relative to the uniform. In addition, depending on the person, the position and orientation of an accouterment on the person's uniform may vary. For example, officers and enlisted personnel have different requirements defining the position and orientation for the placement of an accouterment on the uniform. Further, male and female personnel have different requirements defining the position and orientation for the placement of an accouterment on the uniform.

One type of accouterment worn on a military uniform is a U.S. insignia. The regulations associated with the U.S. insignia define the type of insignia and the position and orientation of the insignia for male officers, female officers, male enlisted personnel and female enlisted personnel. For example, for male enlisted personnel, the U.S. insignia consists of the block letters "U.S." in a gold-colored metal, 7/16 inch in height placed on a 1-inch diameter disk also in a gold-colored metal. The U.S. insignia disk is placed on a uniform coat with the bottom of the U.S. insignia disk being 1 inch above the notch, centered on the right collar, with the centerline of the insignia parallel to the inside edge of the lapel.

Complying with the regulations associated with the placement of an accouterment on the uniform can be difficult and time consuming for military personnel because the regulations may not be known and, even if the regulations are known, the physical placement of the accouterment on the uniform in compliance with the regulations can still be problematic because of the difficulty in trying to measure distances on a uniform. If a person does not place an accouterment on his or her uniform in accordance with the regulations, the person may be subject to possible disciplinary action.

SUMMARY

The present application generally pertains to a tool for positioning and aligning accouterments, such as insignia, ribbons, badges and citations, on the uniform of military personnel. The tool can be used by both officers and enlisted personnel to place an accouterment on their uniform. The tool has several cut-outs or openings that can accommodate different types of accouterments. The tool also has several reference lines that correspond to the notches in the collars of the uniforms. The location of the openings and the reference lines on the tool provides the proper spacing for the placement of the accouterment on the uniform according to the corresponding regulations. In addition, the tool also has tabs that have different widths that correspond to different spacing requirements in the regulations. The tabs can be used to ensure that the accouterment being placed is properly spaced. When the tool is placed on the uniform and aligned appropriately for the accouterment to be placed on the uniform, the tool can provide for the proper spacing of the accouterment on the uniform and assist with the alignment or orientation of the accouterment on the uniform.

One advantage of the present application is that the tool is made from a clear material to enable the markings on the tool to be imposed on a uniform.

Another advantage of the present application is that the tool has a compact size to permit the tool to be carried on a person.

Still another advantage of the present application is that the tool has easily visible markings when the tool is placed against a uniform.

Other features and advantages of the present application will be apparent from the following more detailed description of the identified embodiments, taken in conjunction with the accompanying drawings which show, by way of example, the principles of the application.

BRIEF DESCRIPTION OF THE DRAWINGS

Wherever possible, the same reference numbers are used throughout the drawings to refer to the same or like parts.

DETAILED DESCRIPTION

Figure 1:
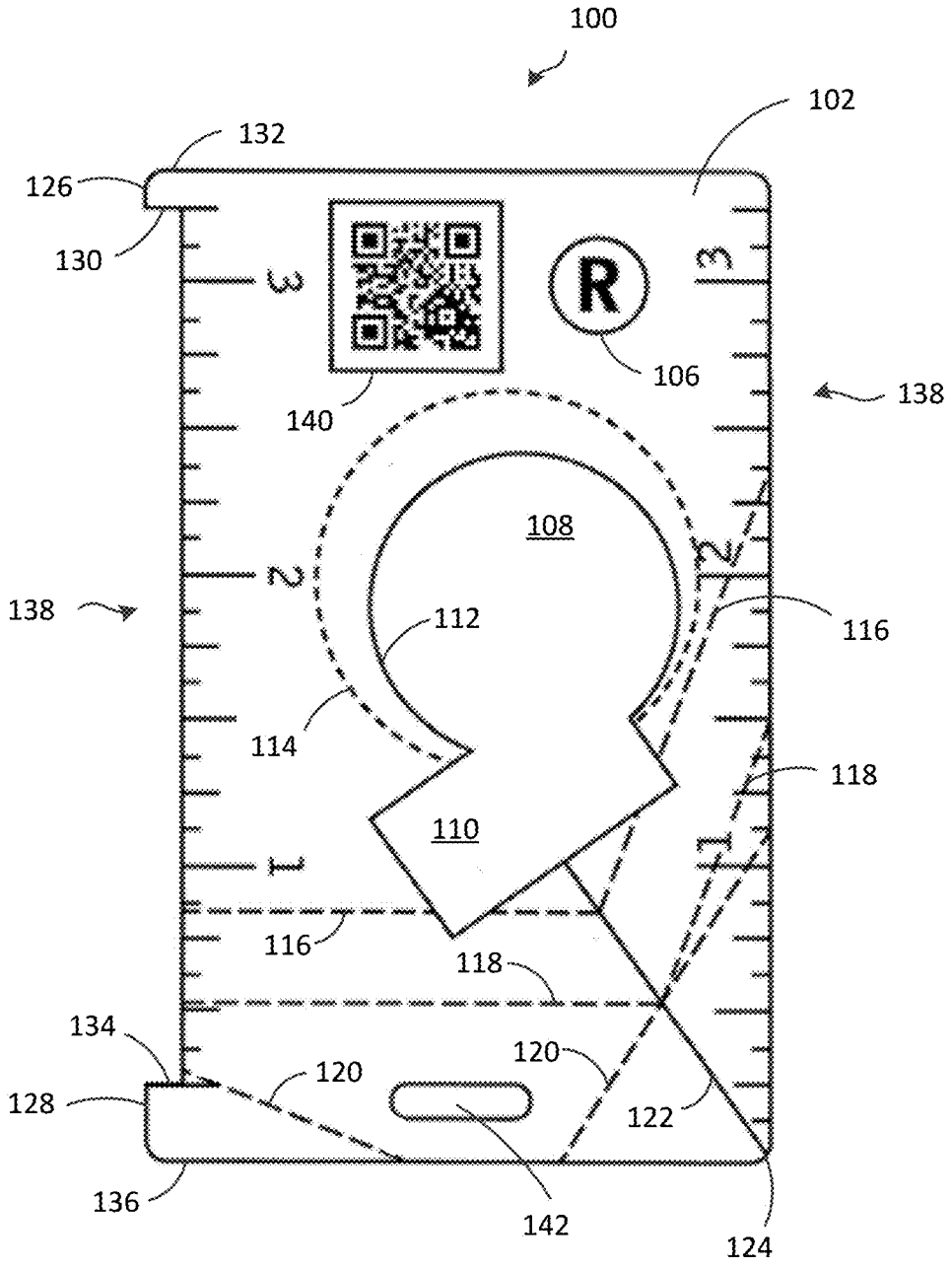
FIG. 1 is a front view of an embodiment of a tool for placing an accouterment on a uniform.
Figure 2:
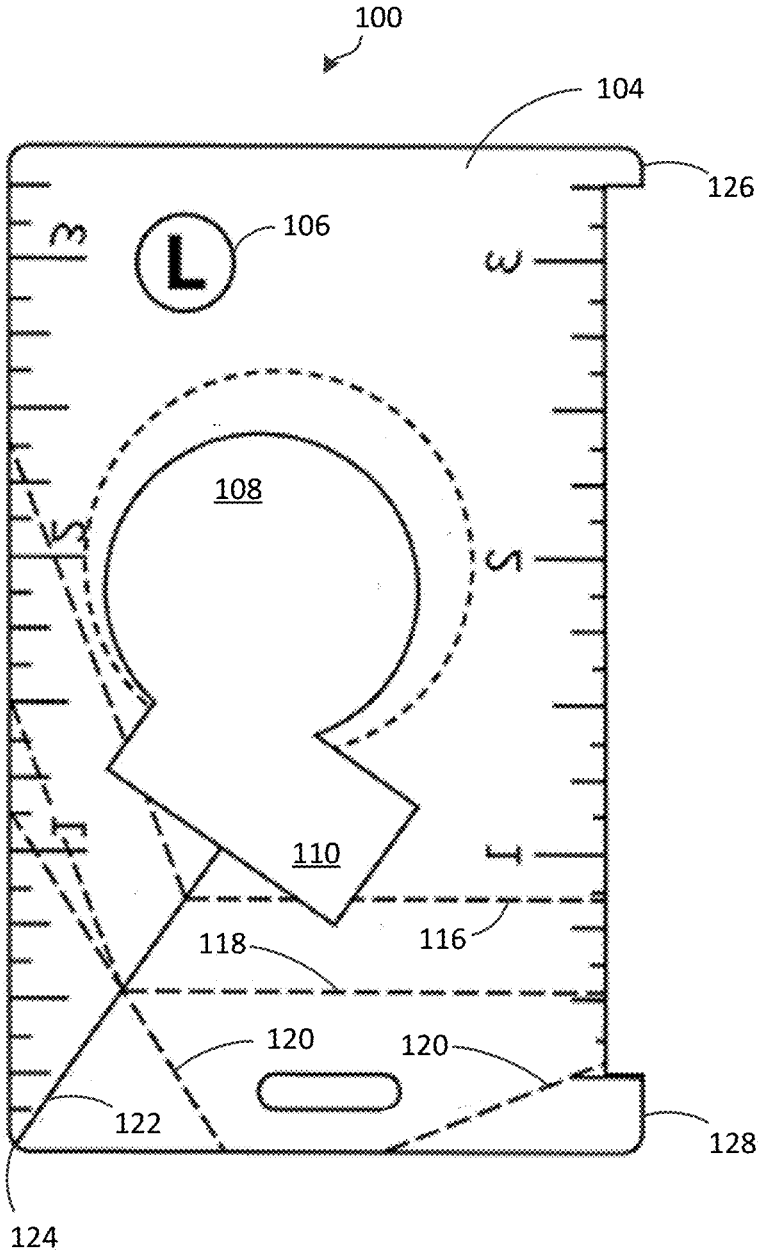
FIG. 2 is a rear view of the tool of FIG. 1.

FIGS. 1 and 2 show an embodiment of a tool for placing accouterments on both the right and left sides of a uniform. FIG. 1 shows a front view of an embodiment of a tool 100 and FIG. 2 shows the rear view of the tool 100 from FIG. 1. In one embodiment, the tool 100 can be used to place accouterments, such as ribbons, awards, citations, special skill badges, U.S. insignia and branch insignia, on a uniform.

The tool 100 is made from a substantially planar piece of material having a generally rectangular shape. The tool 100 may have rounded corners as shown in FIGS. 1 and 2, but may have angled corners in other embodiments. In one embodiment, the tool 100 can be made from a translucent plastic. However, in other embodiments, different materials, e.g., polymers, metals, cardboard, etc., having different optical properties, e.g., transparent or opaque, can also be used for the tool 100. In still other embodiments, the tool 100 can have different geometric shapes, e.g., square, trapezoid, rhombus, oval, etc. The tool 100 has a first side 102 with a substantially planar surface and a second side 104 opposite the first side 102 also with a substantially planar surface. The tool 100 can have a thickness, i.e., the distance between the planar surface of the first side 102 and the planar surface of the second side 104, in the range of about 0.020 in. to about 0.050 in.

In one embodiment, the first side 102 of the tool 100 can be used to place accouterments on the right side of the uniform and the second side 104 of the tool 100 can be used to place accouterments on the left side of the uniform. In another embodiment, the first side 102 of the tool 100 can be used to place accouterments of the left side of the uniform and the second side 104 of the tool 100 can be used to place accouterments on the right side of the uniform. The tool 100 can include an indicia 106 placed on each of the first side 102 and the second side 104 to indicate the side of the uniform for which the tool 100 can be used. As shown in FIGS. 1 and 2, the indicia 106 on the first side 102 of the tool 100 can be an "R" in a circle to indicate use of the tool 100 with the right side of the uniform and the indicia 106 on the second side 104 of the tool 100 can be an "L" in a circle to indicate use of the tool 100 with the left side of the uniform. However, in other embodiments, different indicia 106, e.g., using the word "Left" or "Right," can be used to distinguish which side of the tool 100 can be used with the left and right sides of the uniform.

The tool 100 includes a first opening 108 and a second opening 110 to receive accouterments, e.g., insignias, to be placed on the uniform. As shown in FIGS. 1 and 2, the first opening 108 and the second opening 110 can be continuous. In other words, a portion of the first opening 108 can overlap or be concurrent with a portion of the second opening 110. The first opening 108 and the second opening are bordered by an edge 112 extending between the first side 102 and the second side 104. The edge 112 defines the shapes of the first opening 108 and the second opening 110. In another embodiment, the first opening 108 can be separated from second opening 110, i.e., the first opening 108 does not overlap the second opening 110, and each of the first opening 108 and the second opening 110 can be defined by a corresponding edge 112. The dimensions of the first opening 108 and the second opening 110 can be sized to receive a particular type of accouterment, e.g., a U.S. insignia or a branch insignia. In addition, the tool 100 can include a reference line 114 indicating a portion of the tool that can be removed by the user of the tool 100 to increase the size of the first opening 108 to accommodate a different type of accouterment, e.g., an infantry disk.

In the embodiment of FIGS. 1 and 2, the first opening 108 can be used to position a U.S. insignia or a branch insignia on the uniform of enlisted personnel and the second opening 110 can be used to position a U.S. insignia on the uniform of officers. To ensure that the accouterment is properly positioned on the uniform, the first opening 108 and the second opening 110 can be used with reference lines indicated on both the first side 102 and the second side 104 of the tool 100. A first reference line 116, a second reference line 118, a third reference line 120 and a fourth reference line 122 can be marked or placed on both sides 102, 104 of the tool 100 to assist with the positioning of the accouterment on the uniform. In one embodiment, each of the first reference line 116, the second reference line 118, the third reference line 120 and the fourth reference line 122 on the first side 102 correspond directly to the first reference line 116, the second reference line 118, the third reference line 120 and the fourth reference line 122 on the second side 104 when a translucent or transparent material is used for the tool 100.

The first reference line 116 corresponds to the shape of the notch on the collar of the uniform for female enlisted personnel. The first reference line 116 can be placed on the tool at a predetermined location relative to the first opening 108. The relative positioning of the first reference line 116 to the first opening 108 results in the first opening 108 corresponding to the defined location for the placement of the accouterment on the uniform when the first reference line 116 is aligned with the notch in the collar of the uniform for female enlisted personnel. In other words, when the tool 100 is placed on a side of the uniform for female enlisted personnel and the first reference line 116 is aligned with the notch in the collar of the uniform, the location of the first opening 108 in the tool 100 corresponds to the proper location of the accouterment to be placed on the uniform for female enlisted personnel.

The second reference line 118 corresponds to the shape of the notch on the collar of the uniform for male personnel (both officers and enlisted personnel). The second reference line 118 can be placed on the tool at a predetermined location relative to the first opening 108 and the second opening 110. The relative positioning of the second reference line 118 to the first opening 108 and the second opening 110 results in the first opening 108 (for enlisted personnel) and the second opening 110 (for officers) corresponding to the defined locations for the placement of the accouterment on the uniform when the second reference line 118 is aligned with the notch in the collar of the uniform for male personnel (both officers and enlisted personnel). In other words, when the tool 100 is placed on a side of the uniform for male enlisted personnel and the second reference line 118 is aligned with the notch in the collar of the uniform, the location of the first opening 108 in the tool 100 corresponds to the proper location of the accouterment to be placed on the uniform for male enlisted personnel. Similarly, when the tool 100 is placed on a side of the uniform for male officers and the second reference line 118 is aligned with the notch in the collar of the uniform, the location of the second opening 110 in the tool 100 corresponds to the proper location of the accouterment to be placed on the uniform for male officers.

The third reference line 120 corresponds to the shape of the notch on the collar of the uniform for female officers. The third reference line 120 can be placed on the tool at a predetermined location relative to the second opening 110. The relative positioning of the third reference line 120 to the second opening 110 results in the second opening 110 corresponding to the defined location for the placement of the accouterment on the uniform when the third reference line 120 is aligned with the notch in the collar of the uniform for female officers. In other words, when the tool 100 is placed on a side of the uniform for female officers and the third reference line 120 is aligned with the notch in the collar of the uniform, the location of the second opening 110 in the tool 100 corresponds to the proper location of the accouterment to be placed on the uniform for female officers.

The fourth reference line 122 can be used with second opening 110 to place a second accouterment on a uniform. The fourth reference line 122 can extend from an edge of the second opening 110 near the second reference line 118 to a corner 124 of the tool 100. The fourth reference line 122 can bisect the second reference line 118 at the angle in the second reference line 118 corresponding to the notch on the collar of the uniform for male personnel. The fourth reference line 122 can extend a predetermined distance from the second opening 110 to the corner 124 that corresponds to the defined location for the placement of a second accouterment on the uniform relative to a first accouterment placed in the second opening 110 when the second reference line 118 is aligned with the notch in the collar of the uniform for male officers. In other words, when the tool 100 is placed on a side of the uniform for male officers and the second reference line 118 is aligned with the notch in the collar of the uniform, the location of the second opening 110 in the tool 100 corresponds to the proper location of a first accouterment to be placed on the uniform for male officers and the corner 124 corresponds to the proper location of a second accouterment to be placed on the uniform for male officers. In one embodiment, the second opening 110 can be used to place a U.S. insignia and the corner 124 can be used to place a branch insignia on the uniform of male officers.

In other embodiments, the reference lines 116-122 can be indicated by embedding a material in the tool 100 that can be seen on the first side 102 and the second side 104 of the tool 100. In another embodiment, the reference lines 116-122 can be indicated by one or more protrusions extending from the first side 102 and the second side 104 of the tool 100 or one or more grooves formed in the first side 102 and the second side 104 of the tool 100. In still another embodiment, the reference lines 116-122 can be indicated on the first side 102 and the second side 104 by one or more slots extending through the tool 100.

The tool 100 has a first tab 126 and a second tab 128 extending from the tool 100. The first tab 126 and the second tab 128 can be used to space accouterments, e.g., ribbons, badges, and citations, to be placed on the uniform. The first tab 126 has a width corresponding to a first predetermined measurement or dimension and the second tab 128 has a width corresponding to a second predetermined measurement or dimension different from the first predetermined measurement. The width of the first tab 126 can be defined as the distance between an inner edge 130 and an outer edge 132. The width of the second tab 128 can be similarly defined as the distance between an inner edge 134 and an outer edge 136. In one embodiment, the inner edges 130, 134 of the tabs 126, 128 can define a notch in tool 100 and the outer edges 132, 136 of the tabs 126, 128 can be continuous with the outer perimeter or edge of the tool 100. In one embodiment, the width of the first tab 126 can be about ⅛ inch and the width of the second tab can be about ¼ inch.

The tabs 126, 128 of the tool 100 can be used to provide the proper spacing for accouterments placed on the uniform. To obtain the proper spacing for accouterments, the user has to first determine whether the first tab 126 or the second tab 128 provides the desired spacing. After the tab 126, 128 with the desired spacing is determined, the inner edge 130, 134 or the outer edge 132, 136 of the tab 126,128 can be abutted against a fixed feature or item on the uniform, e.g., a pocket edge or a ribbon that has already been affixed to the uniform, and the accouterment to be affixed to the uniform is abutted against the other edge 132,136 of the tab 126, 128 to obtain the desired spacing. In one embodiment, the inner edge 130, 134 of the tabs 126, 128 can be placed against the fixed feature and the outer edge 132, 136 of the tabs 126, 128 can be used for the accouterment to be placed on the uniform.

A ruler 138 can be marked or placed on the first side 102 and the second side 104 of the tool 100 to assist with the positioning of accouterment on the uniform. The ruler 138 can be marked or placed near one or more edges of the tool 100. In the embodiment, shown in FIGS. 1 and 2, rulers 138 can be placed on opposing sides of the tool 100. To use the ruler 138 to obtain the proper positioning and/or spacing of an accouterment on the uniform, the tool 100 can be placed on the uniform and can be adjusted such that the ruler 138 can be used to obtain the measurements that are needed for the proper alignment and placement of the accouterments on the uniform.

In the embodiment shown in FIGS. 1 and 2, the tool 100 includes a 3D bar code or QR (quick response) code 140 and a slot 142 that can be used to receive a fastening device such as a clip. The QR code 140 can be scanned by the user using a camera in a computing device, e.g., a smart phone or tablet, to obtain additional information regarding the placement of accouterments on the uniform. The slot 142 can be used to attach the tool 100 to a fastening device associated with a lanyard to permit the tool 100 to be carried with the user.

Figure 3:
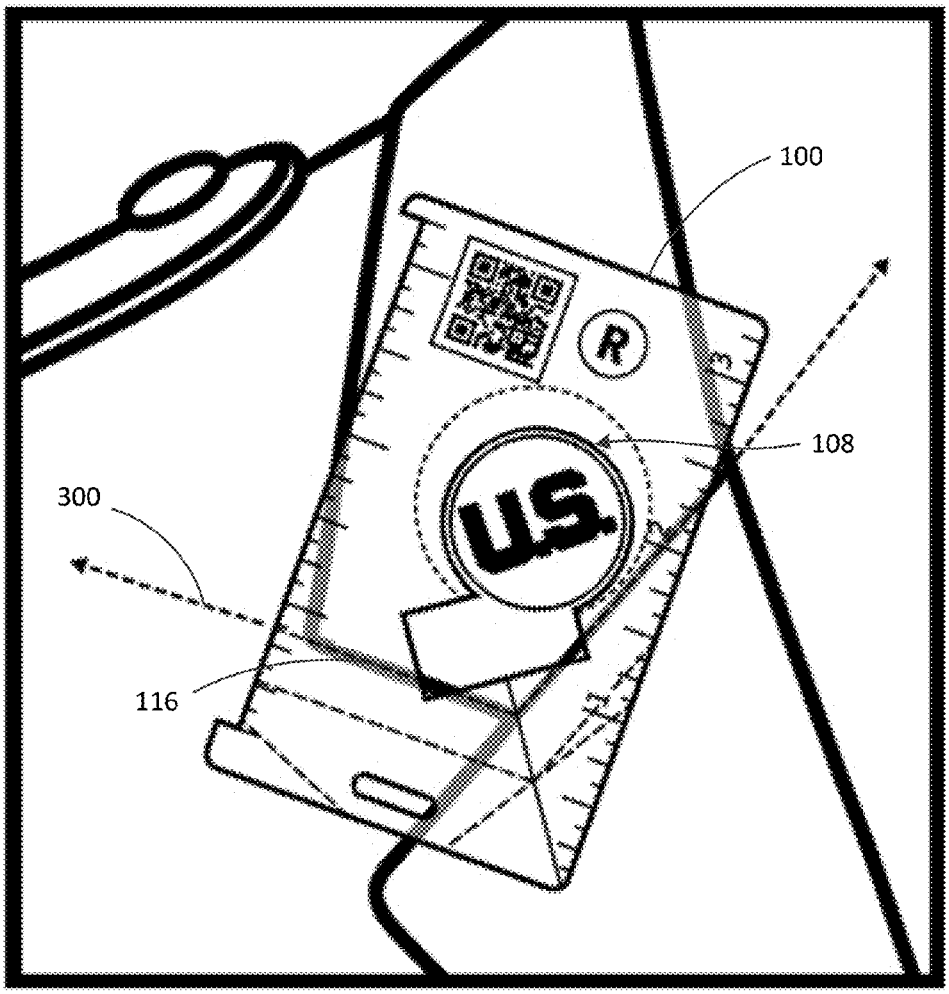
FIGS. 3-8 show embodiments of the tool being used to place accouterments on uniforms.

FIGS. 3-8 show different embodiments of the tool 100 being used to place accouterments on uniforms. In the embodiment of FIG. 3, the tool 100 is used to place U.S. insignia and branch insignia on the uniform of female enlisted personnel. As shown in FIG. 3, the tool 100 with first side 102 being exposed is placed on the right collar of the uniform for female enlisted personnel. The first reference line 116 is aligned with the notch of the collar on the uniform (represented by dotted line 300). Once the first reference line 116 is aligned with the notch of the collar, the U.S. insignia is placed in first opening 108 and affixed to the uniform. A similar process can be performed to place the branch insignia on the left collar of the uniform using second side 104 of the tool 100.

Figure 4:
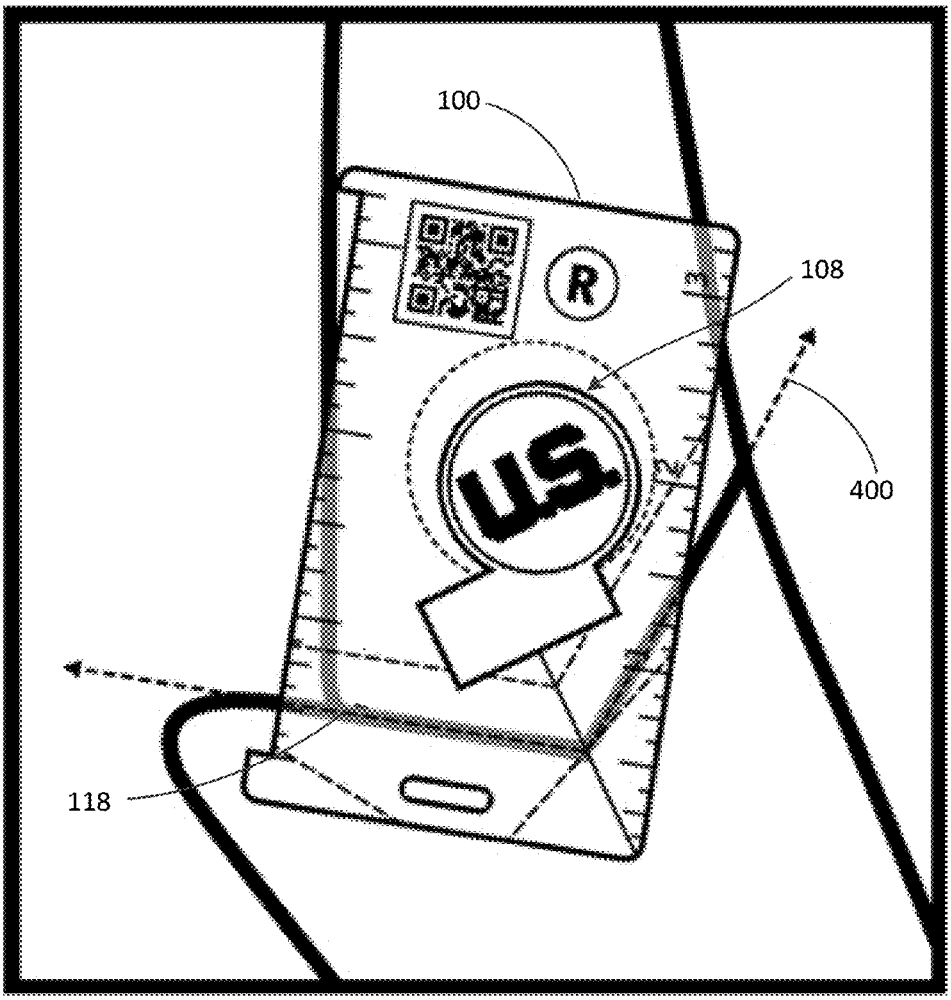

In the embodiment of FIG. 4, the tool 100 is used to place U.S. insignia and branch insignia on the uniform of male enlisted personnel. As shown in FIG. 4, the tool 100 with first side 102 being exposed is placed on the right collar of the uniform for male enlisted personnel. The second reference line 118 is aligned with the notch of the collar on the uniform (represented by dotted line 400). Once the second reference line 118 is aligned with the notch of the collar, the U.S. insignia is placed in first opening 108 and affixed to the uniform. A similar process can be performed to place the branch insignia on the left collar of the uniform using second side 104 of the tool 100.

Figure 5:
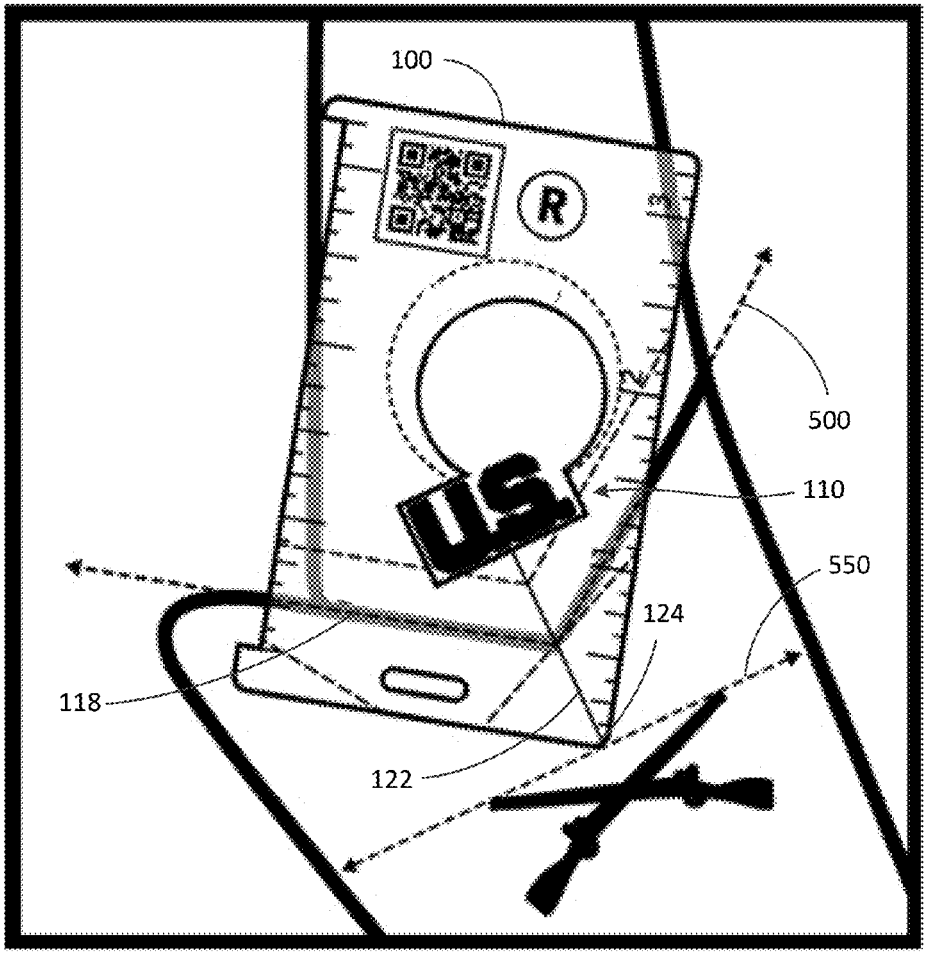

In the embodiment of FIG. 5, the tool 100 is used to place U.S. insignia and branch insignia on the uniform of male officers. As shown in FIG. 5, the tool 100 with first side 102 being exposed is placed on the right collar of the uniform for male officers. The second reference line 118 is aligned with the notch of the collar on the uniform (represented by dotted line 500). Once the second reference line 118 is aligned with the notch of the collar, the U.S. insignia is placed in second opening 110 and affixed to the uniform. With the second reference line 118 still being aligned with the notch of the collar, the top of the branch insignia (represented by dotted line 550) can be placed next to corner 124. The branch insignia can then be centered with respect to fourth reference line 122. A similar process can be performed to place the U.S. insignia and the branch insignia on the left collar of the uniform using second side 104 of the tool 100.

Figure 6:
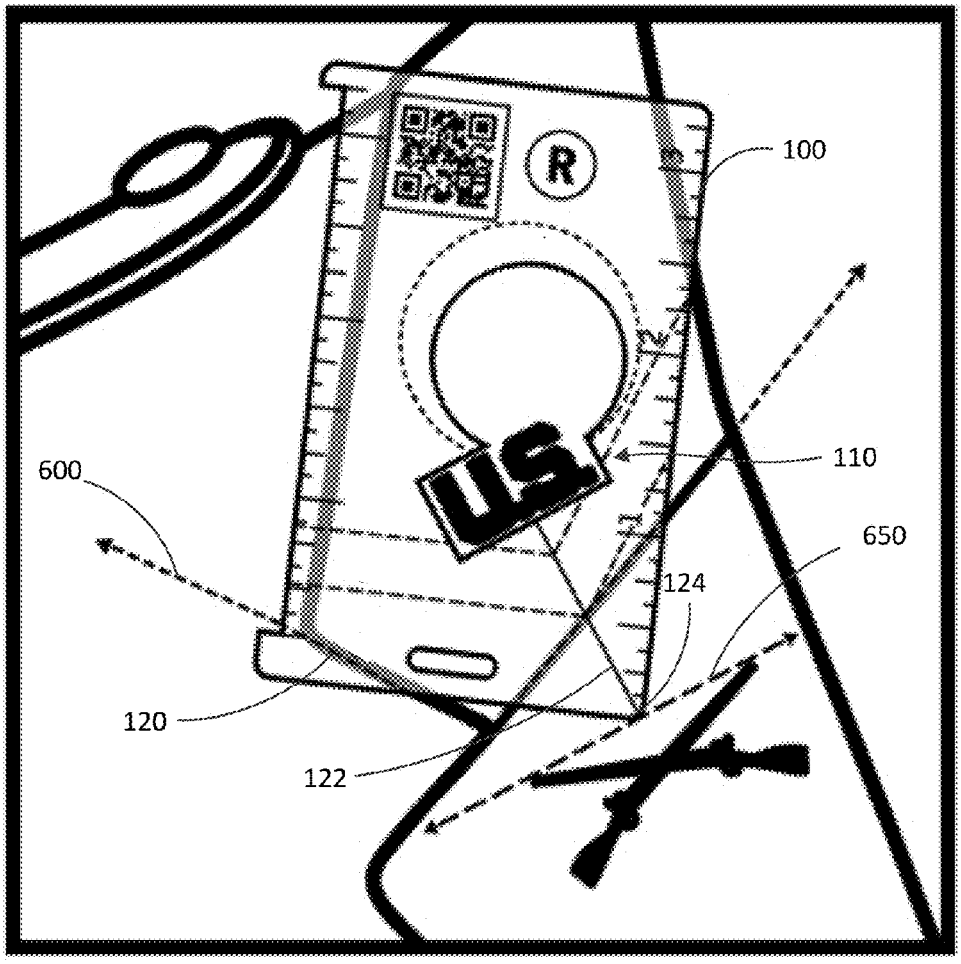

In the embodiment of FIG. 6, the tool 100 is used to place U.S. insignia and branch insignia on the uniform of female officers. As shown in FIG. 6, the tool 100 with first side 102 being exposed is placed on the right collar of the uniform for male officers. The third reference line 120 is aligned with the notch of the collar on the uniform (represented by dotted line 600). Once the third reference line 120 is aligned with the notch of the collar, the U.S. insignia is placed in second opening 110 and affixed to the uniform. With the third reference line 120 still being aligned with the notch of the collar, the top of the branch insignia (represented by dotted line 650) can be placed next to corner 124. The branch insignia can then be centered with respect to fourth reference line 122. A similar process can be performed to place the U.S. insignia and the branch insignia on the left collar of the uniform using second side 104 of the tool 100.

Figure 7:
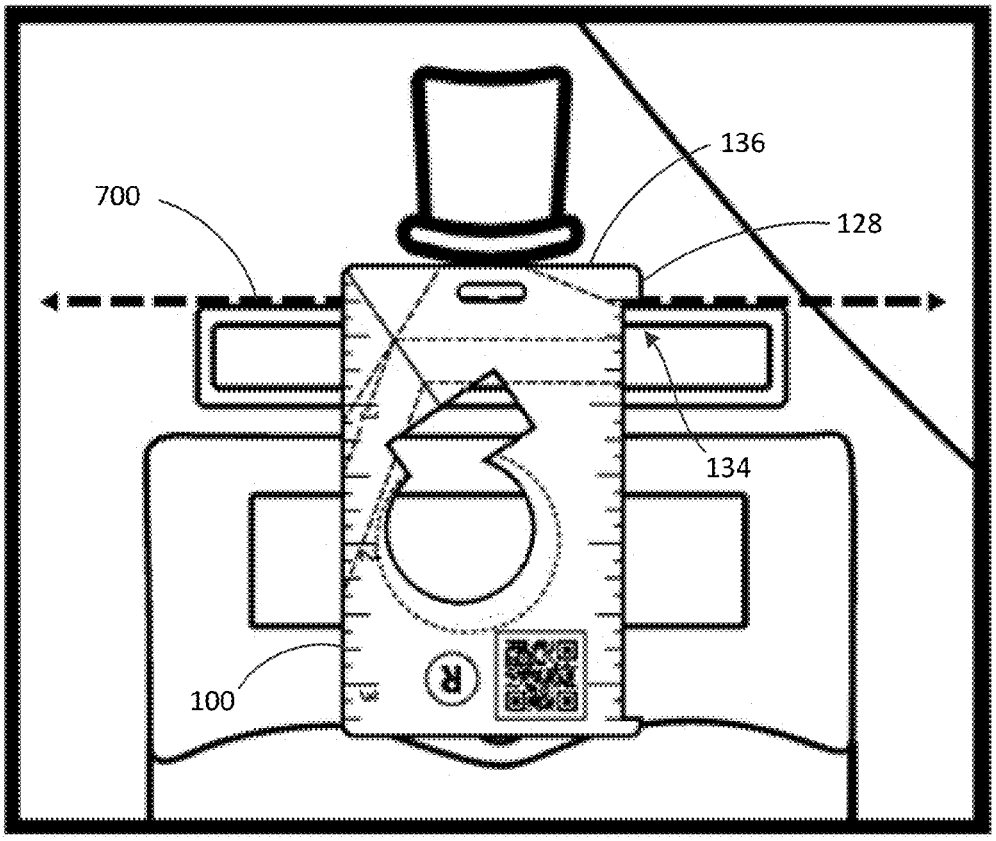
Figure 8:
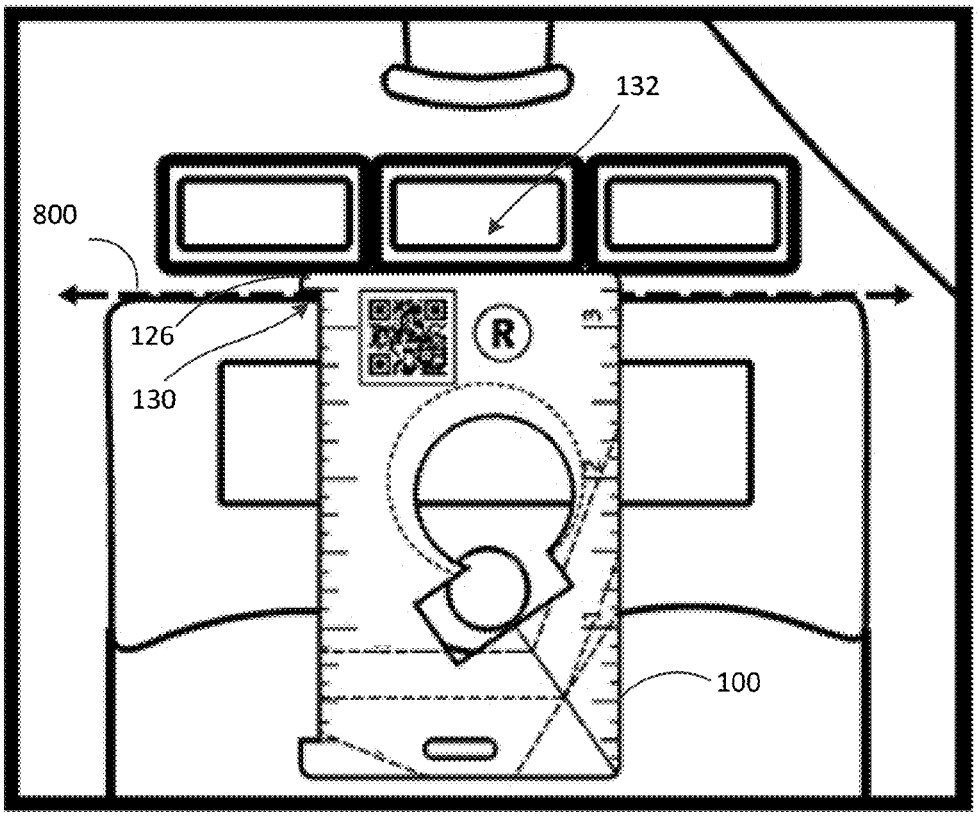

In the embodiment of FIGS. 7 and 8, the tool 100 is used to place ribbons and citations on a uniform. As shown in FIG. 7, the tool 100 with first side 102 being exposed is placed substantially perpendicularly on the uniform with the inner edge 134 of tab 128 being aligned with the upper edge of ribbons that have been affixed to the uniform (represented by dotted line 700). Once the inner edge 134 is aligned with the upper edge of the ribbons, the bottom of a citation that has been centered on the uniform can be aligned with the outer edge 136 of the tab 128 and affixed to the uniform. As shown in FIG. 8, the tool 100 with first side 102 being exposed is placed substantially perpendicularly on the uniform with the inner edge 130 of tab 126 being aligned with the edge of the pocket of the uniform (represented by dotted line 800). Once the inner edge 130 is aligned with the edge of the pocket, one or more ribbons that have been centered on the uniform can be aligned with the outer edge 132 of the tab 126 and affixed to the uniform.

Figure 9:
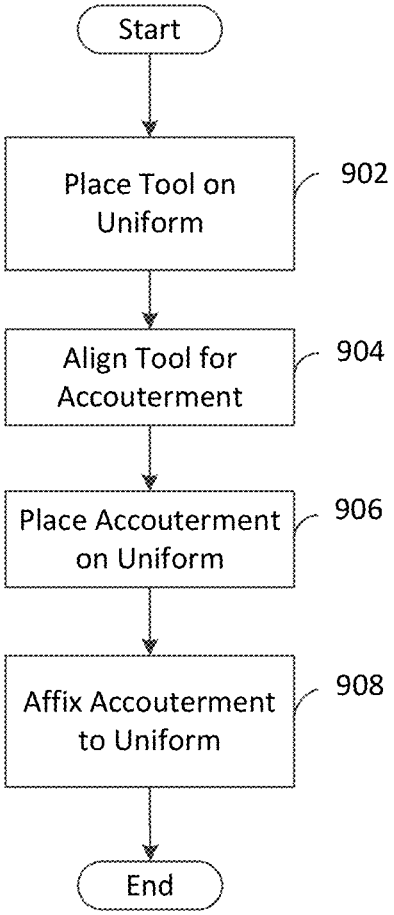
FIG. 9 shows an embodiment of a process for placing an accouterment on a uniform.

FIG. 9 shows an embodiment of a process for placing accouterments on a uniform. The process begins by placing the tool 100 on the uniform (step 902) with either the first side 102 or the second side 104 being exposed, i.e., the side facing away from the uniform. The exposed side of the tool 100 corresponds to the side of the uniform, e.g., the right side or the left side, that is to receive the accouterment. Depending on the accouterment to be placed on the uniform, either side of the tool 100 may be exposed. For example, either side of the tool 100 can be exposed when using tabs 126, 128. After the tool 100 is placed on the uniform, the tool 100 has to be aligned on the uniform (step 904) for placement of the accouterment. The alignment of the tool 100 can involve aligning one of reference lines 116-120 with the corresponding notch on the collar of the uniform or aligning a tab 126-128 with a pocket or affixed accouterment on the uniform.

When the tool 100 is aligned on the uniform, the accouterment is placed on the uniform (step 906). The placement of the accouterment can include positioning the accouterment in either the first opening 108 or the second opening 110 or aligning an edge of an accouterment with an outer edge 132, 136 of a tab 126, 128. Once the accouterment is placed in the proper position according to the tool 100, the accouterment can be affixed or attached to the uniform (step 908).

Although the figures herein may show a specific order of method steps, the order of the steps may differ from what is depicted. Also, two or more steps may be performed concurrently or with partial concurrence. Variations in step performance can depend on the software and hardware systems chosen and on designer choice. All such variations are within the scope of the application. Software implementations could be accomplished with standard programming techniques, with rule based logic and other logic to accomplish the various connection steps, processing steps, comparison steps and decision steps.

It should be understood that the identified embodiments are offered by way of example only. Other substitutions, modifications, changes and omissions may be made in the design, operating conditions and arrangement of the embodiments without departing from the scope of the present application. Accordingly, the present application is not limited to a particular embodiment, but extends to various modifications that nevertheless fall within the scope of the application. It should also be understood that the phraseology and terminology employed herein is for the purpose of description only and should not be regarded as limiting.

What is claimed is:

1. A tool to position accouterments on a uniform, comprising:

a component having a first planar surface and a second planar surface opposite the first planar surface, the component also having an opening extending through the component for receiving an accouterment to be placed on a uniform;

a reference line indicated on the first planar surface, the reference line corresponding to a feature on the uniform;

a tab extending from the component, the tab having a width corresponding to a dimension used to place an accouterment on a uniform; and wherein the opening is positioned in the component relative to the reference line such that the accouterment is positioned at a predetermined location on the uniform when the accouterment is inserted through the opening while the reference line is aligned with the feature on the uniform.

2. The tool of claim 1, wherein the tab comprises a first edge and a second edge opposite the first edge, the first edge configured to align the tab with a fixed feature on the uniform and the second edge being configured to align the accouterment on the uniform.

3. The tool of claim 2, wherein the second edge is continuous with an outer edge of the component.

4. The tool of claim 1, wherein the tab is a first tab and the width is a first width; and wherein the tool further comprises a second tab extending from the component, the second tab having a second width corresponding to a dimension used to place an accouterment on a uniform, the second width being different from the first width.

5. The tool of claim 4, wherein the first tab and the second tab are positioned at opposite ends of the component.

6. The tool of claim 1, wherein the component is made of a translucent material and the reference line is visible from the second planar surface.

7. The tool of claim 1, further comprising at least one ruler indicated on the first planar surface.

8. The tool of claim 1, wherein the reference line is a first reference line, the feature being a first feature and the accouterment being a first accouterment, and wherein the tool further comprises:

a second reference line indicated on the second planar surface, the second reference line corresponding to a second feature on the uniform; and wherein the opening being positioned in the component relative to the second reference line to position a second accouterment placed in the opening when the second reference line is aligned with the second feature on the uniform.

9. A tool to position accouterments on uniforms, comprising:

a component having a first planar surface and a second planar surface opposite the first planar surface, the component also having a first opening is extending through the component for receiving a first accouterment to be placed on a first uniform and a second opening extending through the component for receiving a second accouterment to be placed on a second uniform;

a first reference line indicated on the first planar surface, the first reference line corresponding to a feature on the first uniform;

a second reference line indicated on the first planar surface, the second reference line corresponding to a feature on the second uniform; and wherein the first opening is positioned in the component relative to the first reference line such that the first accouterment is positioned at a predetermined location on the first uniform when the first accouterment is inserted through the first opening and the first reference line is aligned with the feature on the first uniform, and wherein the second opening is positioned in the component relative to the second reference line such that the second accouterment is positioned at a predetermined location on the second uniform when the second accouterment is inserted through the second opening and the second reference line is aligned with the feature on the second uniform.

10. The tool of claim 9, further comprising:

a third reference line indicated on the first planar surface, the third reference line corresponding to a feature on a third uniform; and wherein the second opening is positioned in the component relative to the third reference line to position on the third uniform the second accouterment placed in the second opening when the third reference line is aligned with the feature on the third uniform.

11. The tool of claim 9, further comprising:

a third reference line indicated on the first planar surface, the third reference line extending from the second opening to a corner of the component; and wherein the corner of the component is positioned relative to the second opening to position on the second uniform a third accouterment placed next to the corner when the second reference line is aligned with the feature on the second uniform, the third reference line is configured to correspond to a centerline of the third accouterment.

12. The tool of claim 9, wherein the first opening is continuous with the second opening.

13. A method of placing accouterments on uniforms, the method comprising:

placing a tool on one uniform of a plurality of uniforms, the tool having a plurality of openings to receive corresponding accouterments and a plurality of reference lines, each reference line of the plurality of reference lines associated with an opening of the plurality of openings and corresponding to a feature on a uniform;

selecting a reference line from the plurality of reference lines, the selected reference line associated with a corresponding feature on the one uniform;

aligning the selected reference line on the tool with the corresponding feature on the one uniform;

placing an accouterment in the associated opening for the selected reference line;

affixing the accouterment placed in the associated opening to the one uniform upon the selected reference line being aligned with the corresponding feature on the one uniform;

wherein the plurality of openings includes a first opening and a second opening, the first opening for receiving a first accouterment and the second opening for receiving a second accouterment; and wherein the plurality of reference lines includes a first reference line, a second reference line and a third reference line, the first reference line associated with the first opening and corresponding to a notch in a first uniform, the second reference line associated with both the first opening and the second opening and corresponding to a notch in a second uniform, the third reference line associated with the second opening and corresponding to a notch in a third uniform.

14. The method of claim 13, further comprising:

placing a third accouterment on the uniform next to a corner of the tool; and affixing the third accouterment to the uniform upon the selected reference line being aligned with the corresponding feature of the one uniform, wherein the selected reference line is one of the second reference line or the third reference line.

15. The method of claim 14, further comprising centering the third accouterment with respect to a fourth reference line extending from the second opening to the corner of the tool, the fourth reference line bisecting the selected reference line.

16. A method of placing accouterments on uniforms, the method comprising:

placing a tool on a first uniform, the tool having a first opening extending through the tool for receiving a first accouterment to be placed on the first uniform and a second opening extending through the tool for receiving a second accouterment to be placed on a second uniform, wherein a first reference line on the tool corresponds to a feature on the first uniform, and wherein a second reference line on the tool corresponds to a feature on the second uniform;

aligning the first reference line with the feature on the first uniform;

inserting the first accouterment through the first opening when the first reference line is aligned with the feature on the first uniform, wherein the first opening is positioned in the component relative to the first reference line such that the first accouterment is positioned at a first predetermined location on the first uniform when the first accouterment is inserted through the first opening while the first reference line is aligned with the feature on the first uniform;

affixing the first accouterment to the first uniform at the first predetermined location, wherein the second opening is positioned in the component relative to the second reference line such that the second accouterment is positioned at a second predetermined location on the second uniform when the second accouterment is inserted through the second opening while the second reference line is aligned with the feature on the second uniform.

17. The method of claim 16, further comprising:

placing the component on the second uniform;

aligning the second reference line with the feature on the second uniform;

inserting the second accouterment through the second opening when the second reference line is aligned with the feature on the second uniform; and affixing the second accouterment to the second uniform at the second predetermined location.

18. The method of claim 16, wherein the first reference line is on a first planar surface of the tool.

19. The method of claim 18, wherein the second reference line is on the first planar surface.

20. The method of claim 19, wherein the tool has a second planar surface opposite the first planar surface.

* * * * *